United States Patent [19]

Phillips

[11] 4,105,005

[45] Aug. 8, 1978

[54] ELECTRONIC IGNITION

[76] Inventor: William Phillips, 1815 Sweetbriar, Palmdale, Calif. 93550

[21] Appl. No.: 658,823

[22] Filed: Feb. 17, 1976

[51] Int. Cl.[2] ..... F02P 3/04; H05B 41/392

[52] U.S. Cl. ..... 123/148 E; 315/209 R

[58] Field of Search ..... 123/148 E; 315/209 R, 315/209 T

[56] References Cited

U.S. PATENT DOCUMENTS 3,753,428 8/1973 Phillips ..... 123/148 E

OTHER PUBLICATIONS

GE "Silicon Controlled Rectifier" Hobby Manual, p. 1.

*Primary Examiner*—Samuel W. Engle
*Assistant Examiner*—Thomas H. Webb
*Attorney, Agent, or Firm*—John E. Wagner; Robert Cunha

[57] ABSTRACT

This invention consists of a pair of modules containing silicon power rectifiers which are wired into the existing ignition system of an automotive vehicle so as to increase the sparkplug life of the internal combustion engine and increase the gasoline mileage thereof.

1 Claim, 4 Drawing Figures

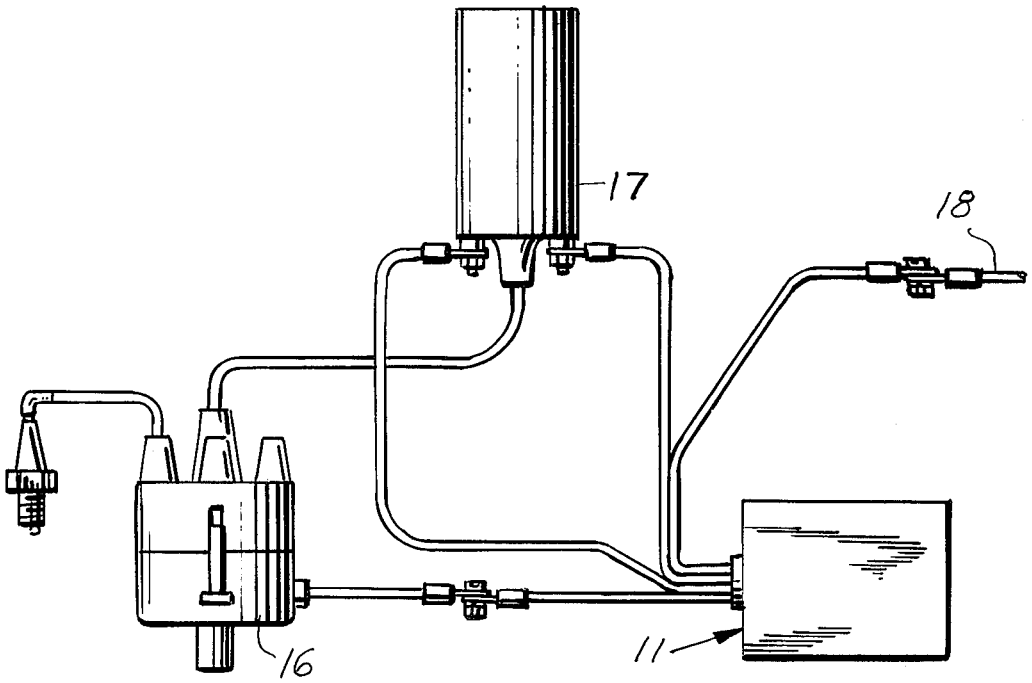
FIG. 1
10
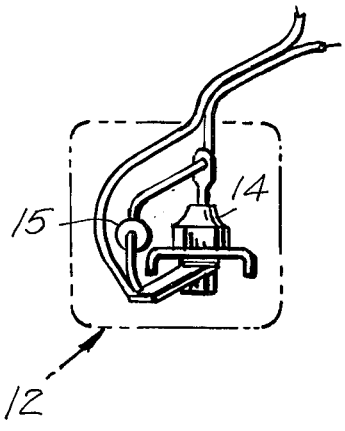
FIG. 2
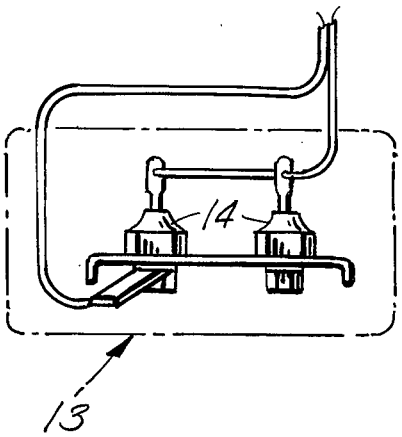
FIG. 3
FIG. 4
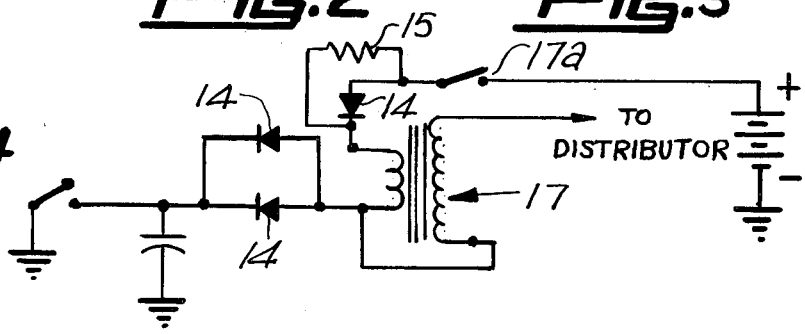

ELECTRONIC IGNITION

This invention relates to ignition systems of internal combustion engines, and more particularly to an electronic ignition system.

The principal object of this invention is to provide an electronic ignition system which will greatly improve the performance of an internal combustion engine of an automotive vehicle.

Another object of this invention is to provide an electronic ignition system which will rectify the alternating current of an ignition system which is a variable frequency, high voltage and sharp peaked sine-wave.

Another object of this invention is to provide electronic ignition which will include silicon power rectifiers within a pair of modules which will serve to change the alternating current to a pulsating direct current.

A further object of this invention is to provide electronic ignition of the type described, which will reduce output voltage, increase output current, increase gasoline mileage, will enable a leaner fuel mixture to be used, and will increase the engine power, will enable the use of regular, and non-leaded fuel, in a vehicle requiring the use of premium fuels, and the invention may be used with a coil of any voltage or any polarity and will serve to eliminate mis-fire, that is blamed on "point bounce".

A still further object of this invention is to provide an electronic ignition system of the type described, which will not be damaged if the connectors are reversed and spark plug, and contact points will last longer while exhaust pollutants will be reduced.

Other objects of this invention are to provide an electronic ignition system which is simple in design, inexpensive to manufacture, rugged in construction, easy to use and efficient in operation.

These and other objects will be readily evident upon a study of the following specification and the accompanying drawing, wherein:

FIG. 1 is a side view of the present invention, shown in elevation with one spark plug illustrated;

FIG. 2 is a vertical view of one of the modules shown removed from the housing and showing the resin encasement in phantom lines;

FIG. 3 is a vertical view of the second module shown removed from the housing and showing the resin encasement in phantom lines;

FIG. 4 is a schematic wiring diagram of the invention.

According to this invention, an electronic ignition system 10 is shown to include a housing 11 of aluminum material which has on its interior, as shown in FIGS. 2 and 3, a pair of resin modules 12 and 13. Module 12 has on its interior, a silicon rectifier diode 14 having wired across it, a resistor 15 and is connected in series between the distributor 16 and the ignition coil 17.

Module 13 includes a pair of silicon rectifier diodes 14. The module 13 is connected in series between the ignition coil 17 and the ignition switch **17*a* to which wire 18** extends.

What I now claim is:

1. An ignition system consisting essentially of a distributor and battery, the negative terminal connected to ground;

an ignition coil comprising a primary and a secondary winding, a first terminal of the secondary winding connected to a first terminal of said primary winding, the second terminal of said secondary winding connected to the distributor;

a first diode, said first diode cathode connected to the second terminal of said primary winding, the first diode anode connected the positive terminal of said battery;

a set of points, one contact being grounded;

a second diode, said second diode cathode connected to the ungrounded contact of said points, the second diode anode connected to the first terminal of said secondary winding, and a condenser in parallel with said points;

wherein diodes are connected to allow electron flow in the primary winding in one direction from the points to the battery, when the points are closed.

* * * * *